US011840090B2

(12) United States Patent
Fukui et al.

(10) Patent No.: US 11,840,090 B2
(45) Date of Patent: Dec. 12, 2023

(54) LIQUID EJECTION HEAD AND LIQUID EJECTION APPARATUS

(71) Applicant: CANON KABUSHIKI KAISHA, Tokyo (JP)

(72) Inventors: Shigeki Fukui, Kanagawa (JP); Isamu Yoneda, Kanagawa (JP); Hiroki Tajima, Kanagawa (JP); Masatoshi Ohira, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 135 days.

(21) Appl. No.: 17/707,771

(22) Filed: Mar. 29, 2022

(65) Prior Publication Data

US 2022/0314629 A1 Oct. 6, 2022

(30) Foreign Application Priority Data

Mar. 31, 2021 (JP) ..... 2021-061754
Dec. 13, 2021 (JP) ..... 2021-201812

(51) Int. Cl.
*B41J 2/175* (2006.01)
*B41J 2/14* (2006.01)

(52) U.S. Cl.
CPC ..... *B41J 2/175* (2013.01); *B41J 2/17506* (2013.01); *B41J 2/17509* (2013.01); *B41J 2002/14411* (2013.01)

(58) Field of Classification Search
CPC .... B41J 2/175; B41J 2/17503; B41J 2/17506; B41J 2/17509; B41J 2/17513; B41J 2/17523; B41J 2/17553; B41J 29/13
See application file for complete search history.

(56) References Cited

U.S. PATENT DOCUMENTS 9,475,298 B2 * 10/2016 Osakabe ..... B41J 2/17536
2013/0008547 A1 * 1/2013 Iwata ..... B60T 17/222 138/89

FOREIGN PATENT DOCUMENTS

JP 2017081084 A 5/2017

* cited by examiner

*Primary Examiner* — Anh T Vo
(74) *Attorney, Agent, or Firm* — Canon U.S.A., Inc. I.P. Division

(57) ABSTRACT

A liquid ejection head includes: a casing, which is hollow, and has an opening at one end; a lid member, which is fixed to an end portion of the opening of the casing; and a member arranged inside the casing. The lid member has a liquid supply port. The member has a first liquid guide groove, and the casing has a second liquid guide groove. The second liquid guide groove extends from the end portion of the opening to a side opposite to the opening in the side wall inner surface of the casing, the first liquid guide groove extends to a side surface of the member which is in contact with or close to the side wall inner surface of the casing, and the first liquid guide groove and the second liquid guide groove are located so as to allow fluid communication therebetween.

14 Claims, 15 Drawing Sheets

LIQUID EJECTION HEAD AND LIQUID EJECTION APPARATUS

BACKGROUND OF THE DISCLOSURE

Field of the Disclosure

The present disclosure relates to a liquid ejection head and a liquid ejection apparatus.

Description of the Related Art

In liquid ejection apparatus that eject liquid such as ink from a liquid ejection head, there has been known a liquid ejection apparatus in which liquid in an amount equivalent to an amount of liquid having been ejected is supplied by negative pressure from a liquid container (liquid tank) to the liquid ejection head. In a liquid ejection apparatus described in Japanese Patent Application Laid-Open No. 2017-81084, a liquid container connected to a liquid ejection head via, for example, a tube is arranged below the liquid ejection head in a vertical direction to generate negative pressure by a liquid head difference.

As an example of the liquid ejection head, there has been known a liquid ejection head having a configuration in which a plate-shaped lid member is joined to a casing having an element substrate that ejects liquid mounted thereto and including a liquid storage portion. A tube connected to a liquid container is connected to a mounting portion of the lid member so that the mounting portion of the lid member is in communication with the liquid storage portion inside the casing, thereby forming a liquid supply path extending from the liquid container to the liquid ejection head. When the casing and the lid member are both resin-molded objects, the casing and the lid member are joined to each other by, for example, an ultrasonic welding method or a vibration welding method.

Sealability of the liquid ejection head is important in keeping negative pressure in the liquid ejection head in order to supply liquid to the liquid ejection head. When the sealability of the liquid ejection head is insufficient, the negative pressure in the liquid ejection head may not be maintained, with the result that the liquid may return from the tube to the liquid container side, or supply of the liquid to the liquid ejection head may be difficult.

From the viewpoint of strengthening stiffness of the casing or the lid member (hereinafter, a casing or the like) and optimizing linear expansion, in the liquid ejection head, filler is mixed to resin forming the casing or the like at a proportion of about 35%.

In the future, an increase in size of the liquid ejection head is expected in order to improve recording speed. When the liquid ejection head is to be increased in size, it is required to further increase the strength of the casing or the like forming the liquid ejection head. Thus, the mixing amount of the filler in the material resin is to be increased.

However, when the mixing amount of the filler is increased, weldability between the casing and the lid member is liable to be lowered, with the result that sealability that can maintain predetermined negative pressure in the liquid ejection head may not be obtained. Further, when the liquid ejection head is increased in size, that is, in a case of the liquid ejection head including the elongated element substrate, a liquid ejection amount per unit time is increased.

Thus, negative pressure (pressure difference) required for smooth supply of the liquid is large, and sealing with higher reliability is required.

SUMMARY OF THE DISCLOSURE

Aspects of the present disclosure provide a liquid ejection head and a liquid ejection apparatus in which reliability of sealing is high. According to the present disclosure, there is provided a liquid ejection head including a casing, which is hollow, and has an opening at one end; a lid member, which is fixed to an end portion of the opening of the casing, and closes the opening; and a member arranged inside the casing, wherein the lid member has a liquid supply port for supplying liquid into the casing, wherein the member has a first liquid guide groove formed in an upper surface of the member which is a surface onto which the liquid supplied through the liquid supply port is to be dropped, and the casing has a second liquid guide groove formed in a side wall inner surface of the casing, and wherein the second liquid guide groove extends from the end portion of the opening which is fixed to the lid member to a side opposite to the opening, the first liquid guide groove extends to a side surface of the member which is disposed adjacent to the side wall inner surface of the casing, and the first liquid guide groove and the second liquid guide groove are disposed so as to allow fluid communication therebetween.

Further features of the present disclosure will become apparent from the following description of exemplary embodiments with reference to the attached drawings.

DESCRIPTION OF THE EMBODIMENTS

Now, embodiments of a liquid ejection head according to the present disclosure are described with reference to the drawings. The following embodiments are examples suitable for carrying out the present disclosure, and the present disclosure is not limited to configurations thereof.

First Embodiment

Figure 1:
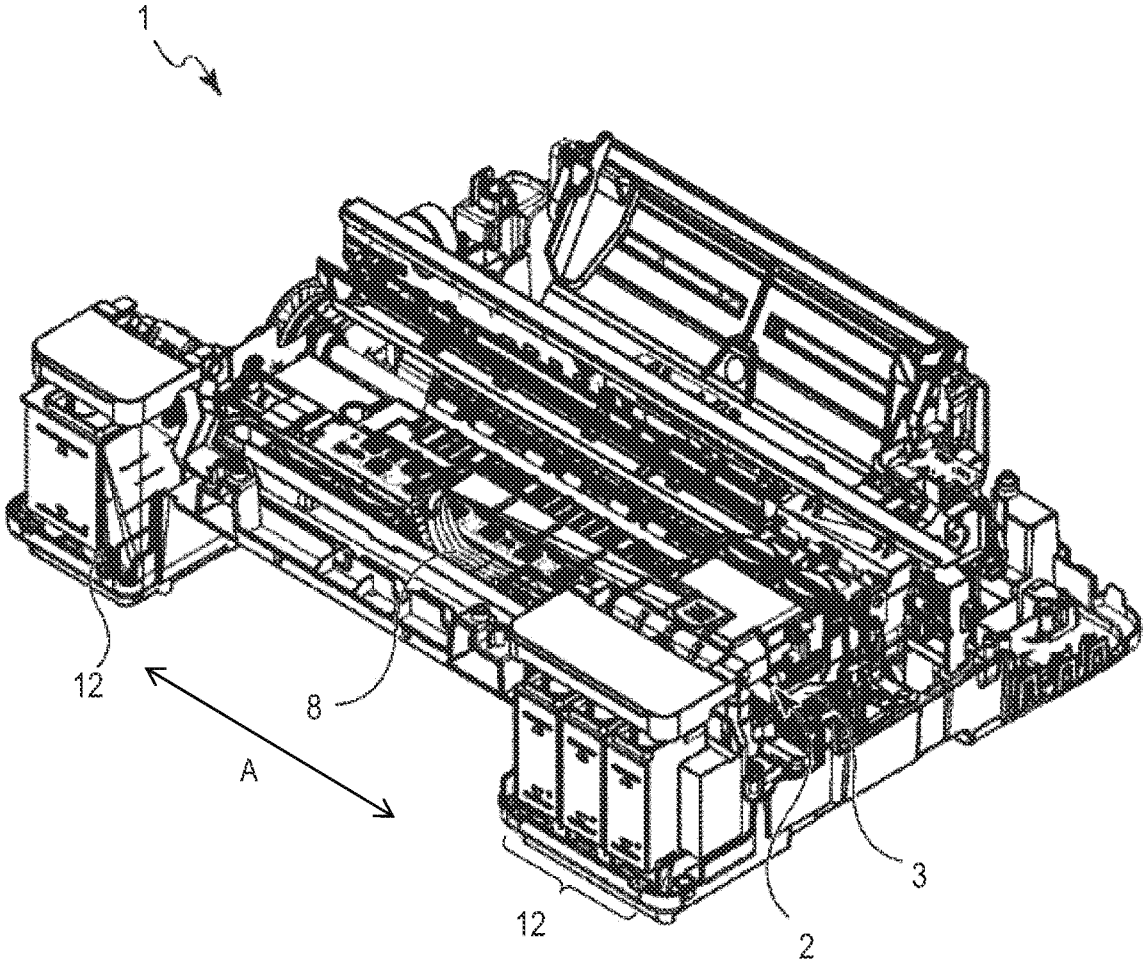
FIG. 1 is a perspective view for illustrating an example of an internal structure of a liquid ejection apparatus of the present disclosure.

FIG. 1 is an illustration of an internal structure of an ink jet recording apparatus being an example of a liquid ejection apparatus 1 according to the present disclosure. The liquid ejection apparatus 1 is a recording apparatus of serial scan type which performs recording by liquid ejection while a liquid ejection head 2 is reciprocated. The liquid ejection head 2 is mounted to a carriage 3, and is coupled to a joint (not shown) provided at an upper part of the carriage 3. The carriage 3 is capable of reciprocating along a guide shaft in a main scanning direction (direction A in FIG. 1) by a carriage motor and a driving force transmission mechanism such as a belt.

Figure 2:
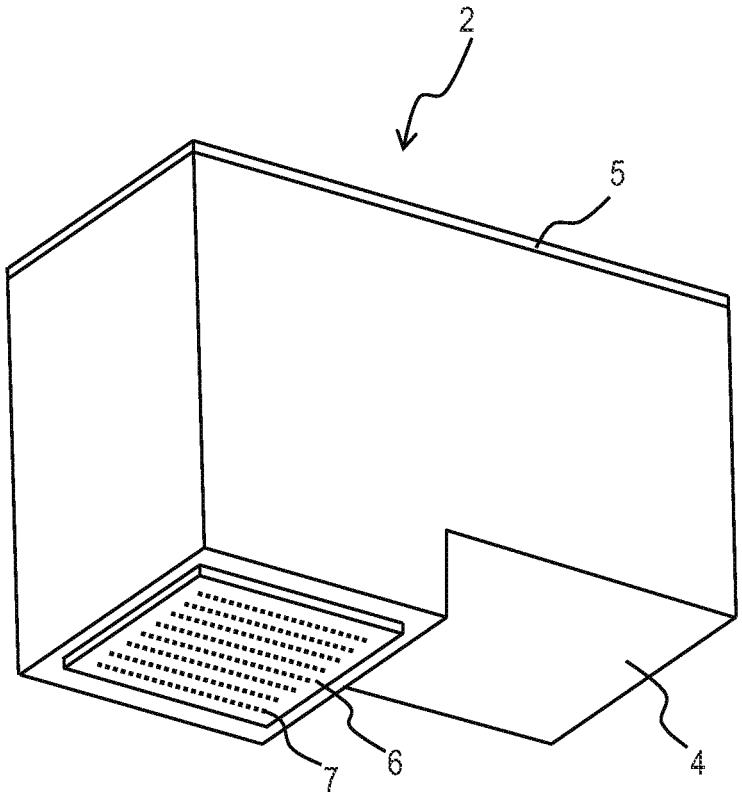
FIG. 2 is a perspective view of a liquid ejection head according to a first embodiment of the present disclosure as viewed from below.
Figure 3A:
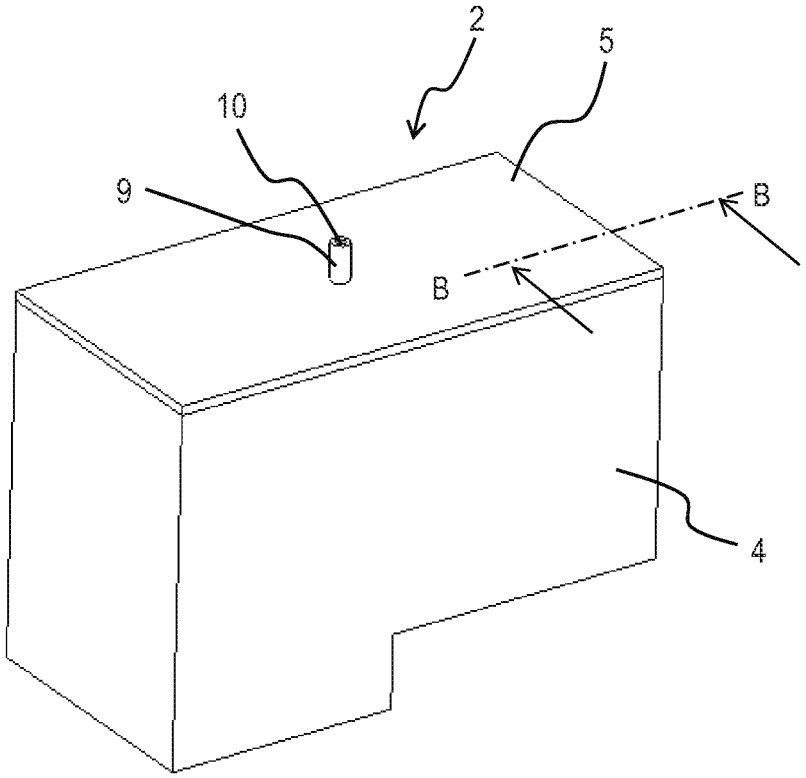
FIG. 3A is a perspective view of the liquid ejection head illustrated in FIG. 2 as viewed from above.
Figure 3B:
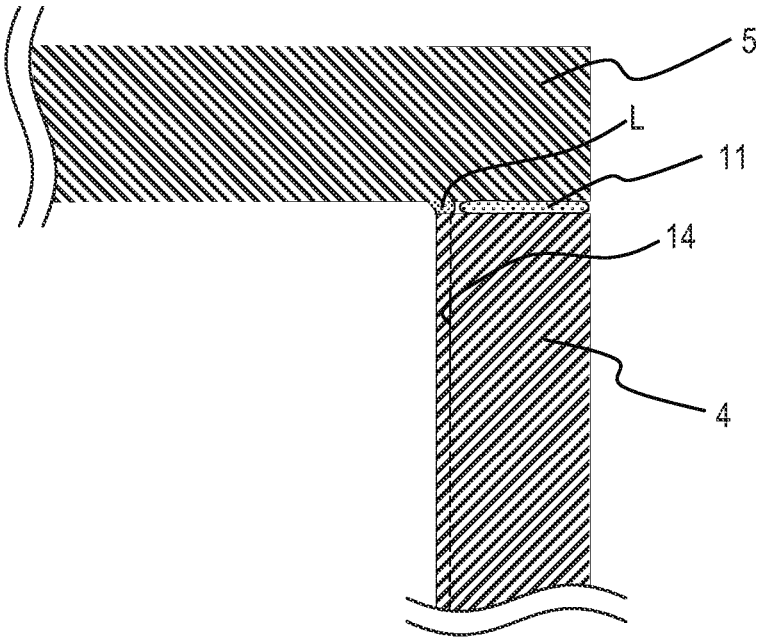
FIG. 3B is a sectional view of the liquid ejection head illustrated in FIG. 3A taken along the line B-B.
Figure 4:
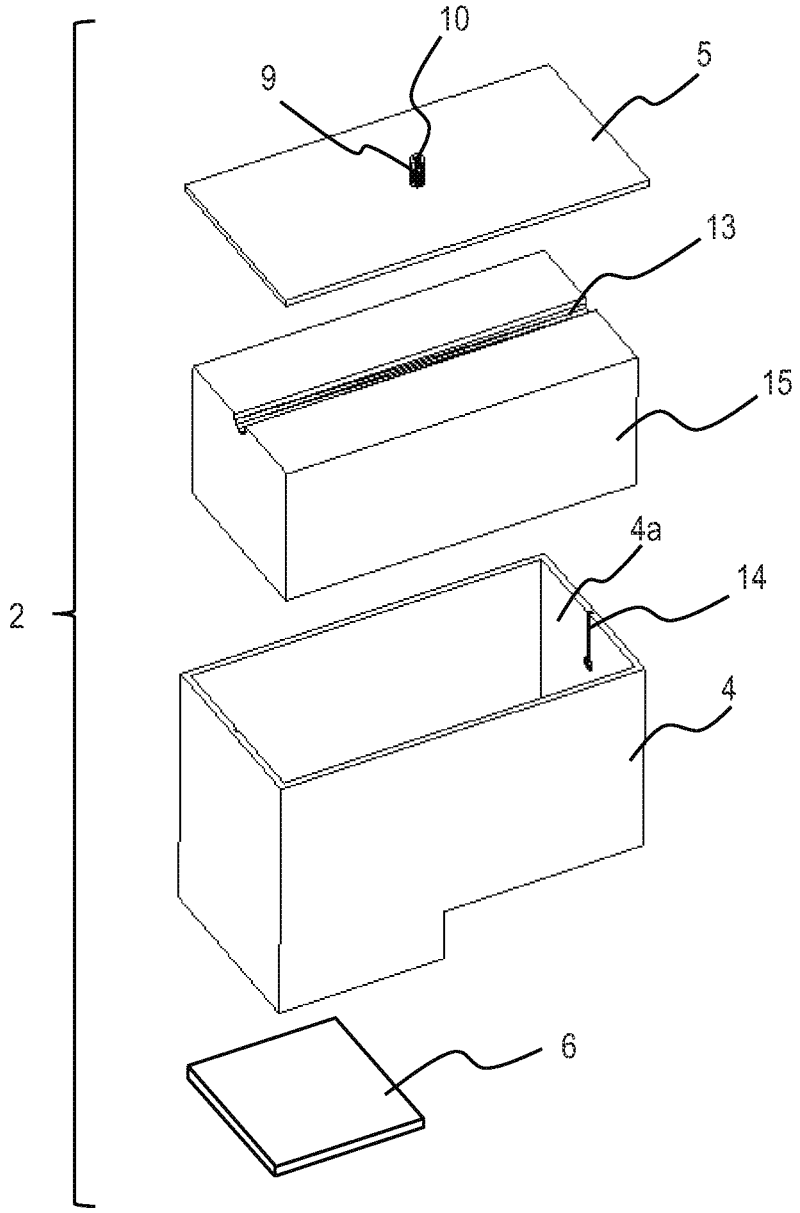
FIG. 4 is an exploded perspective view of the liquid ejection head illustrated in FIG. 2.

FIG. 2 is a perspective view of the liquid ejection head 2 according to this embodiment as viewed from below. FIG. 3A is a perspective view of the liquid ejection head 2 as viewed from above, and FIG. 3B is an enlarged sectional view of a part of the liquid ejection head 2. FIG. 4 is an exploded perspective view of the liquid ejection head 2. The liquid ejection head 2 illustrated in FIG. 2 to FIG. 4 includes a hollow casing 4 and a lid member 5. The casing 4 has an opening at one end. The lid member 5 is fixed to an end portion of the opening (opening end portion) of the casing 4 and closes and seals the opening. The casing 4 has a space for storing liquid (liquid storage portion), and a liquid holding member 15 such as a porous material (see FIG. 4) is accommodated in the liquid storage portion. Further, an element substrate 6 for ejecting liquid (see FIG. 2 and FIG. 4) is mounted to the casing 4 on a side opposite to the opening. Although not illustrated, in the element substrate 6, there are provided a flow passage communicating with the liquid storage portion of the casing 4, and energy generating elements (for example, heat generating elements) that applies energy for ejection (for example, thermal energy) to liquid in a pressure chamber in the flow passage. An ejection port 7 (see FIG. 2), which is opened toward the outside and ejects the liquid applied with energy to the outside, communicates with the pressure chamber. A mounting portion 9 to which one end of a connecting member (for example, a tube) described later is mounted is formed on the lid member 5, and a liquid supply port 10 that passes through the mounting portion 9 and communicates with the liquid storage portion is formed in the lid member 5.

FIG. 3B is a sectional view taken along the line B-B of FIG. 3A, and is an enlarged sectional view of a portion in which the opening end portion of the casing 4 and the lid member 5 are fixed to each other. In this embodiment, the casing 4 and the lid member 5 are joined to each other by a vibration welding method. Specifically, by welding between the casing 4 and the lid member 5 illustrated in FIG. 3B, a fused portion 11 having a thickness of about 0.2 mm is formed. The fused portion 11 is a portion in which the casing 4 and the lid member 5 are melted and mixed to each other, and is a joined portion in which the casing 4 and the lid member 5 are actually joined to each other.

There is a fear in that air gaps that cause minute leakage of liquid or gas may be generated in the fused portion 11 or the vicinity thereof.

Figure 5:
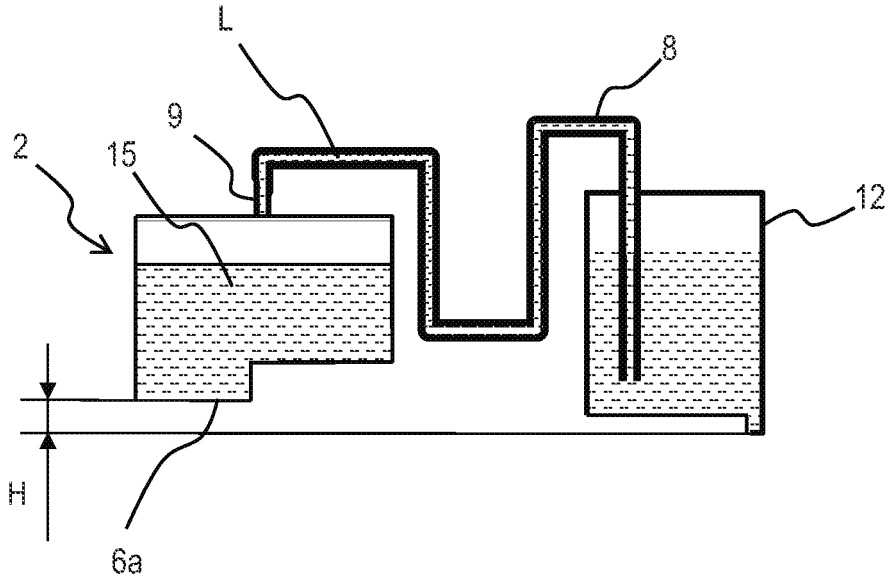
FIG. 5 is a schematic view for illustrating a path of liquid of the liquid ejection apparatus including the liquid ejection head illustrated in FIG. 2.

In FIG. 5, a path of a liquid L of the liquid ejection apparatus 1 including the liquid ejection head 2 is schematically illustrated. One end of a flexible tube 8 which is a type of connecting member is connected to a liquid container 12 fixed to a main body of the liquid ejection apparatus 1, and another end of the tube 8 is mounted to the mounting portion 9 of the lid member 5 of the liquid ejection head 2. With this, the liquid L in the liquid container 12 flows into the liquid storage portion of the casing 4 through the tube 8 and the liquid supply port 10 of the mounting portion 9 of the lid member 5. The liquid L is held in the liquid holding member 15 in the liquid storage portion. The liquid L held in the liquid holding member 15 is fed to the flow passage in the element substrate 6. When an energy generating element corresponding to the flow passage is driven to generate ejection energy, the liquid L applied with energy is ejected as liquid droplets from the ejection port 7 to, for example, a recording medium on the outside.

Figure 6:
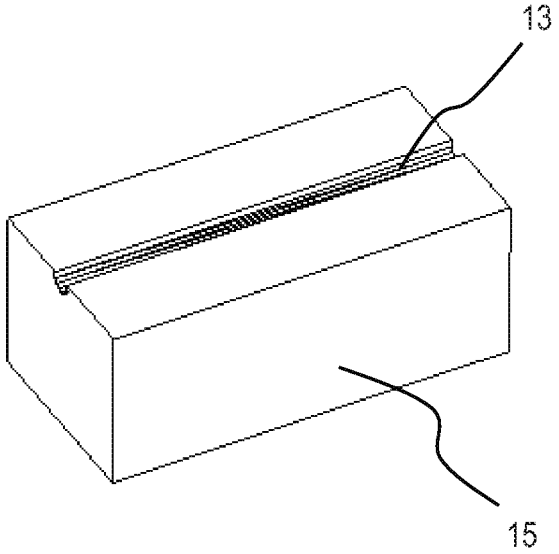
FIG. 6 is a perspective view of a liquid holding member of the liquid ejection head illustrated in FIG. 2.
Figure 7A:
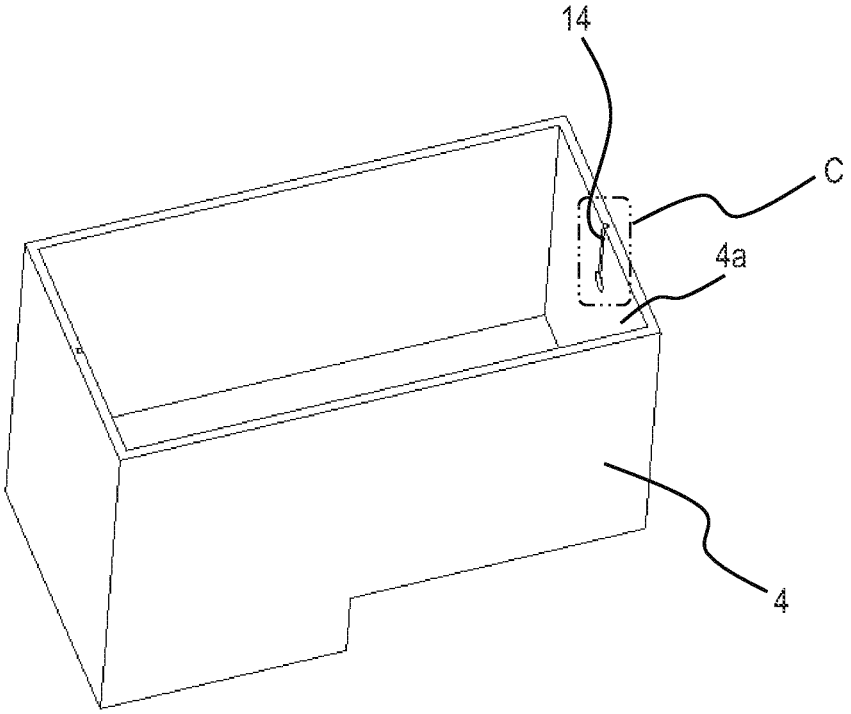
FIG. 7A is a perspective view for illustrating an internal structure of a casing of the liquid ejection head illustrated in FIG. 2.
Figure 7B:
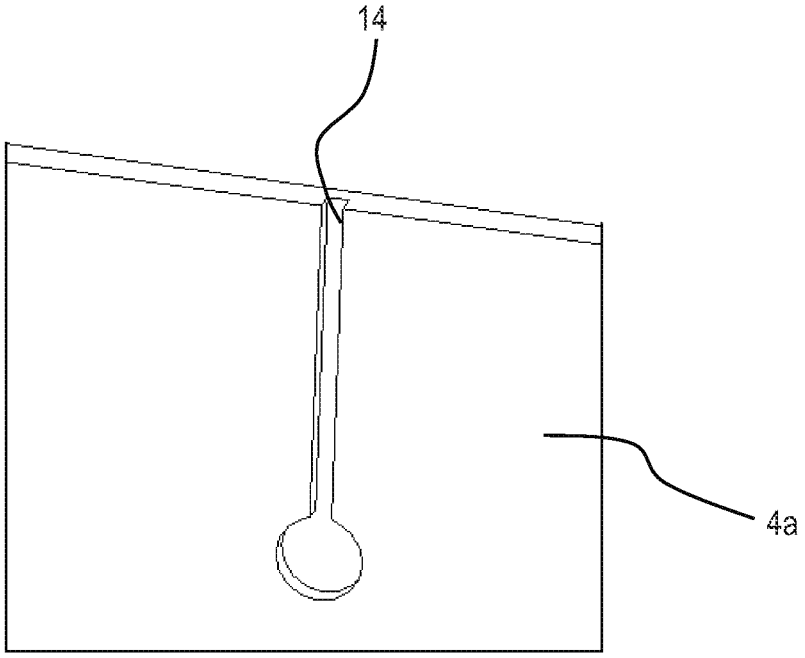
FIG. 7B is an enlarged view of the part C of the casing illustrated in FIG. 7A.

FIG. 6 is a perspective view of the liquid holding member 15 of the liquid ejection head 2 according to this embodiment. FIG. 7A is a perspective view for illustrating an interior of the hollow casing 4 of the liquid ejection head 2 according to this embodiment, and FIG. 7B is an enlarged view for illustrating the part C of FIG. 7A. The liquid holding member 15 of this embodiment is made of polypropylene, and, as illustrated in FIG. 6, a first liquid guide groove 13 is formed in an upper surface of the liquid holding member 15. It is preferred that an inner wall surface of the first liquid guide groove 13 be subjected to surface treatment such that liquid is less liable to penetrate. As illustrated in FIG. 7A and FIG. 7B, a second liquid guide groove 14 is formed in a side wall inner surface 4*a* of the casing 4 in which the liquid holding member 15 is accommodated. The second liquid guide groove 14 extends from the opening end portion to be fixed to the lid member 5 toward an end portion on the opposite side (end portion to which the element substrate 6 is mounted) in the side wall inner surface 4*a* of the casing 4. The second liquid guide groove 14 is terminated in the vicinity of the center of the side wall, and the terminal end portion is formed in an enlarged circular shape. Further, the first liquid guide groove 13 in the liquid holding member 15 extends to side surfaces of the liquid holding member 15 which are in contact with or close to the side wall inner surfaces 4*a* of the casing 4 under a state in which the liquid holding member 15 is accommodated in the liquid storage portion of the hollow casing 4. A part of the second liquid guide groove 14 (preferably, the terminal end portion having an enlarged circular shape) is located on an extension of the first liquid guide groove 13. Under a state in which the liquid holding member 15 is accommodated in the liquid storage portion of the hollow casing 4, the first liquid guide groove 13 in the liquid holding member 15 and the second liquid guide grooves 14 in the casing 4 are located in such a manner as to allow fluid communication therebetween, and are in a so-called fluid communicating state.

Figure 8A:
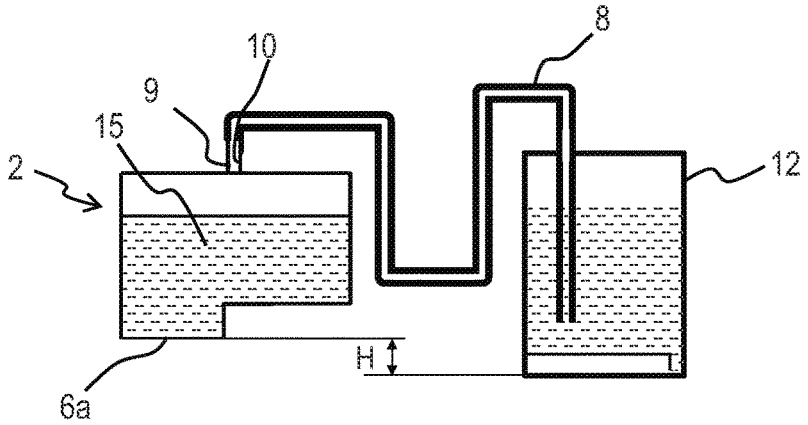
FIG. 8A, FIG. 8B, FIG. 8C, and FIG. 8D are schematic views for sequentially illustrating liquid supply states of the path of liquid illustrated in FIG. 5.
Figure 8B:
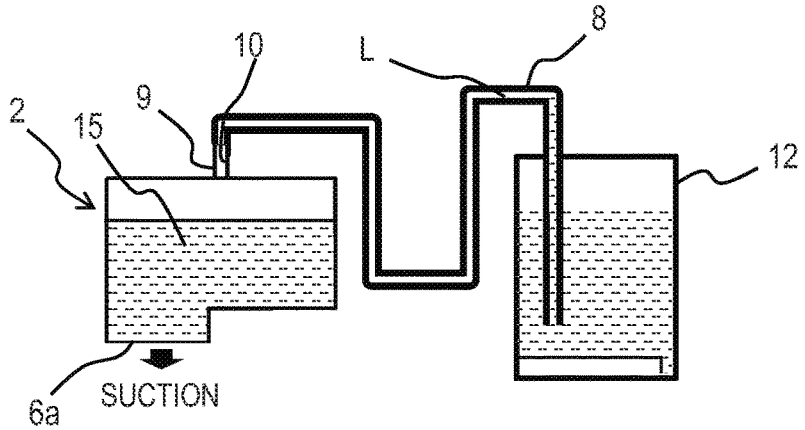
Figure 8C:
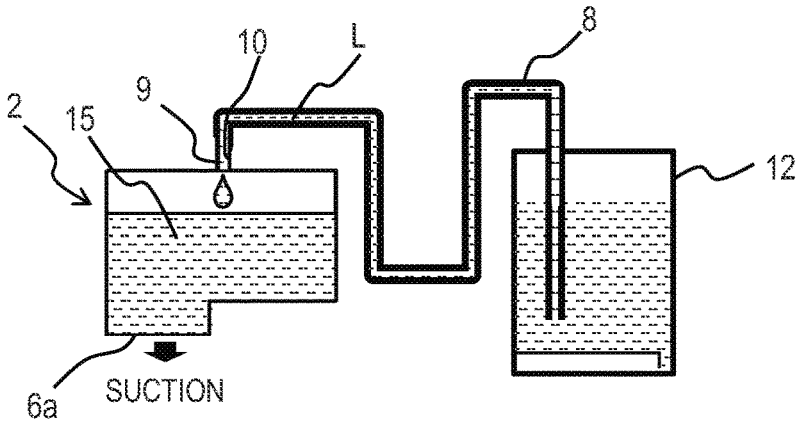
Figure 8D:
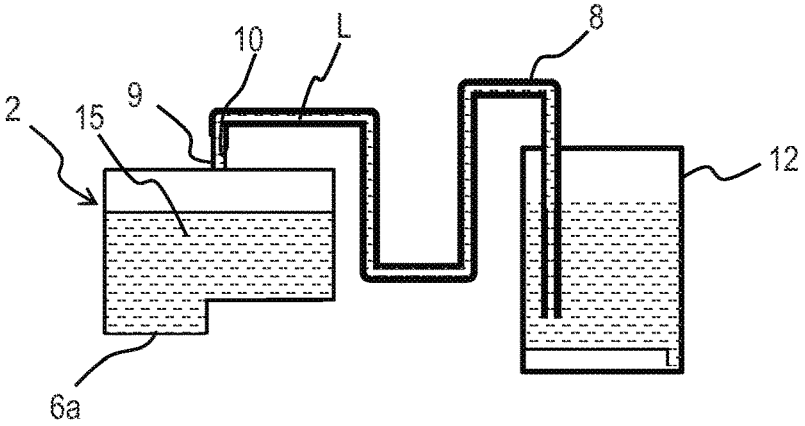

A liquid supply state of the liquid ejection apparatus 1 including the liquid ejection head 2 of this embodiment described above is described. In FIG. 8A to FIG. 8D, supply states of the liquid L at the time of using the liquid ejection apparatus 1 (at the time of sucking the liquid) in the liquid path illustrated in FIG. 5 are sequentially illustrated. FIG. 8A is an illustration of a state in which the liquid ejection head 2 and the liquid container 12 are connected to each other via the tube 8, the liquid L is held in the liquid ejection head 2 and the liquid container 12, and the liquid L is not held in the tube 8. When negative pressure is applied from a forming surface 6*a* for the ejection port 7 (see FIG. 2) of the element substrate 6 of the liquid ejection head 2 under this state to suck the liquid L, the inside of the liquid ejection head 2 becomes negative pressure, and, as illustrated in FIG. 8B, the liquid L in the liquid container 12 passes through the tube 8 to move to the liquid ejection head 2 side. When the liquid suction is further continued, as illustrated in FIG. 8C, the liquid L flows from the tube 8 and passes through the liquid supply port 10 of the lid member 5 to reach the liquid holding member 15 in the liquid storage portion of the casing 4. Then, when the liquid suction from the forming surface 6*a* for the ejection port 7 is ended, due to a liquid head difference H (see FIG. 5 and FIG. 8A), the liquid L does not move and is in a stable state as illustrated in FIG. 8D. At this time, the tube 8 is filled with the liquid L.

A moving state of the liquid L when the liquid L reaches the liquid holding member 15 in the casing 4 as illustrated in FIG. 8C is described. FIG. 9A to FIG. 9D are schematic views for sequentially illustrating the moving states of the liquid L as described above. Part of the liquid L dropped from the tube 8 and the liquid supply port 10 onto the upper surface of the liquid holding member 15 flows into the first liquid guide groove 13. The liquid L is less liable to penetrate in the inner wall surface of the first liquid guide groove 13 owing to the surface treatment. Thus, as indicated by the arrows D in FIG. 9A, the liquid L having flowed into the first liquid guide groove 13 is divided into two systems, and is guided to the second liquid guide grooves 14 formed in the side wall inner surfaces 4*a* of the casing 4.

When a large amount of the liquid L flows into the first liquid guide groove 13, part of the flowing liquid L overflows from the first liquid guide groove 13 and is absorbed into the liquid holding member 15 from a portion of the liquid holding member 15 which is not subjected to surface treatment. The liquid L having been absorbed into the liquid holding member 15 is guided to the element substrate 6, and is ejected to the outside from the ejection port 7 as needed.

Figure 9A:
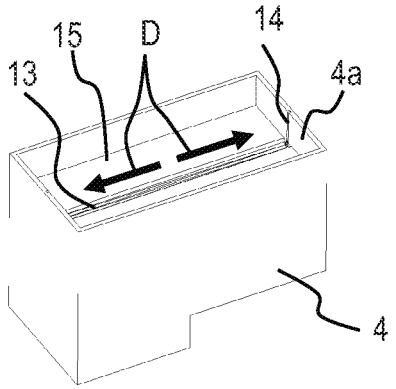
FIG. 9A, FIG. 9B, FIG. 9C, and FIG. 9D are schematic views for sequentially illustrating moving states of liquid in the casing of the liquid ejection head illustrated in FIG. 2.
Figure 9B:
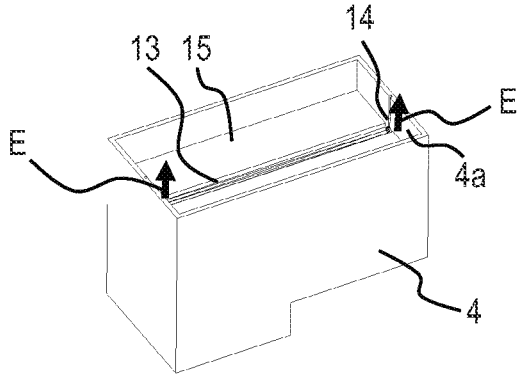

The liquid L having reached the second liquid guide groove 14 as mentioned above moves to an upper side in a vertical direction due to a capillary force of the second liquid guide groove 14 as indicated by the arrows E in FIG. 9B, and reaches the opening end portion of the casing 4 which is fixed to the lid member 5. In general, when a liquid surface height inside a tube is "h" (m), a surface tension of the liquid is T (N/m), a contact angle of the liquid with respect to the tube is θ, density of the liquid is ρ (kg/m$^3$), gravitational acceleration is "g" (m/s$^2$), and a radius of the tube is "r" (m), the capillary force is expressed as $h=2T\cos\theta/\rho gr$. In this embodiment, the second liquid guide groove 14 corresponds to the tube in this calculation expression.

Figure 9C:
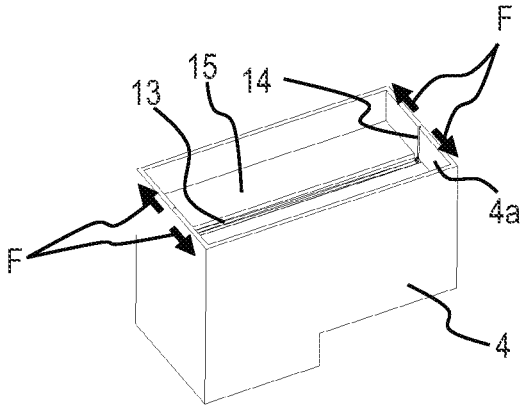
Figure 9D:
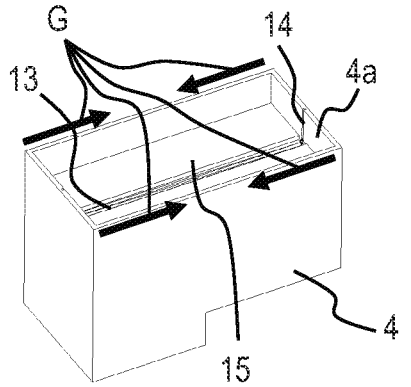

The liquid L having reached the opening end portion of the casing 4 which is fixed to the lid member 5 as mentioned above is divided into four systems as indicated by the arrows F in FIG. 9C, and moves along the opening end portion of the casing 4. As illustrated in FIG. 3B, the movement of the liquid L is caused due to a capillary force generated in a slight gap or dent on the inner side of the hollow casing 4 with respect to the fused portion 11 (joined portion) formed in the portion in which the opening end portion of the casing 4 and the lid member 5 are fixed to each other. The liquid L that moves along the end portion of the opening of the casing 4 in this manner further moves as indicated by the arrows G in FIG. 9D to spread over the entire periphery of the end portion of the opening of the casing 4.

As described above, the liquid L guided by the first liquid guide groove 13 and the second liquid guide grooves 14 spreads over the entire periphery of the opening end portion of the casing 4 which is fixed to the lid member 5. When small air gaps (for example, circular air gaps having a diameter of several tens μm) are generated in the fused portion 11, as illustrated in FIG. 3B, the liquid L having spread over the entire periphery of the opening end portion forms a meniscus that covers the air gaps in the fused portion 11 from the inner side of the casing 4 to close the air gaps. The meniscus of the liquid L is less liable to be unintentionally broken, and the shape is likely to be maintained, thereby suppressing minute leakage of the liquid L in the joined portion between the casing 4 and the lid member 5. In particular, the ejected liquid L and the liquid L held by the tube 8 and the liquid container 12 are present in the surrounding of the liquid ejection head 2, and hence the surrounding of the liquid ejection head 2 is kept at high humidity. Thus, the meniscus of the liquid L which is formed in the opening end portion fixed to the lid member 5 is likely to be held for a long period of time. Further, even if the meniscus of the liquid L is broken, when the liquid suction operation illustrated in FIG. 8A to FIG. 8D is executed to supply the liquid L to the liquid ejection head 2, a meniscus is formed again to close air gaps.

As described above, in this embodiment, the first liquid guide groove 13 in the upper surface of the liquid holding member 15 and the second liquid guide grooves 14 in the side wall inner surfaces 4*a* of the casing 4 guide the liquid L over the entire periphery of the end portion of the opening of the casing 4 which is fixed to the lid member 5. With this, even if minute air gaps are generated in the joined portion (fused portion 11) between the casing 4 and the lid member 5 or the vicinity thereof, the air gaps are closed by the meniscus of the liquid L having been guided over the entire periphery of the opening end portion of the casing 4 to maintain sealability, thereby being capable of improving the reliability of the sealing.

Second Embodiment

Figure 10:
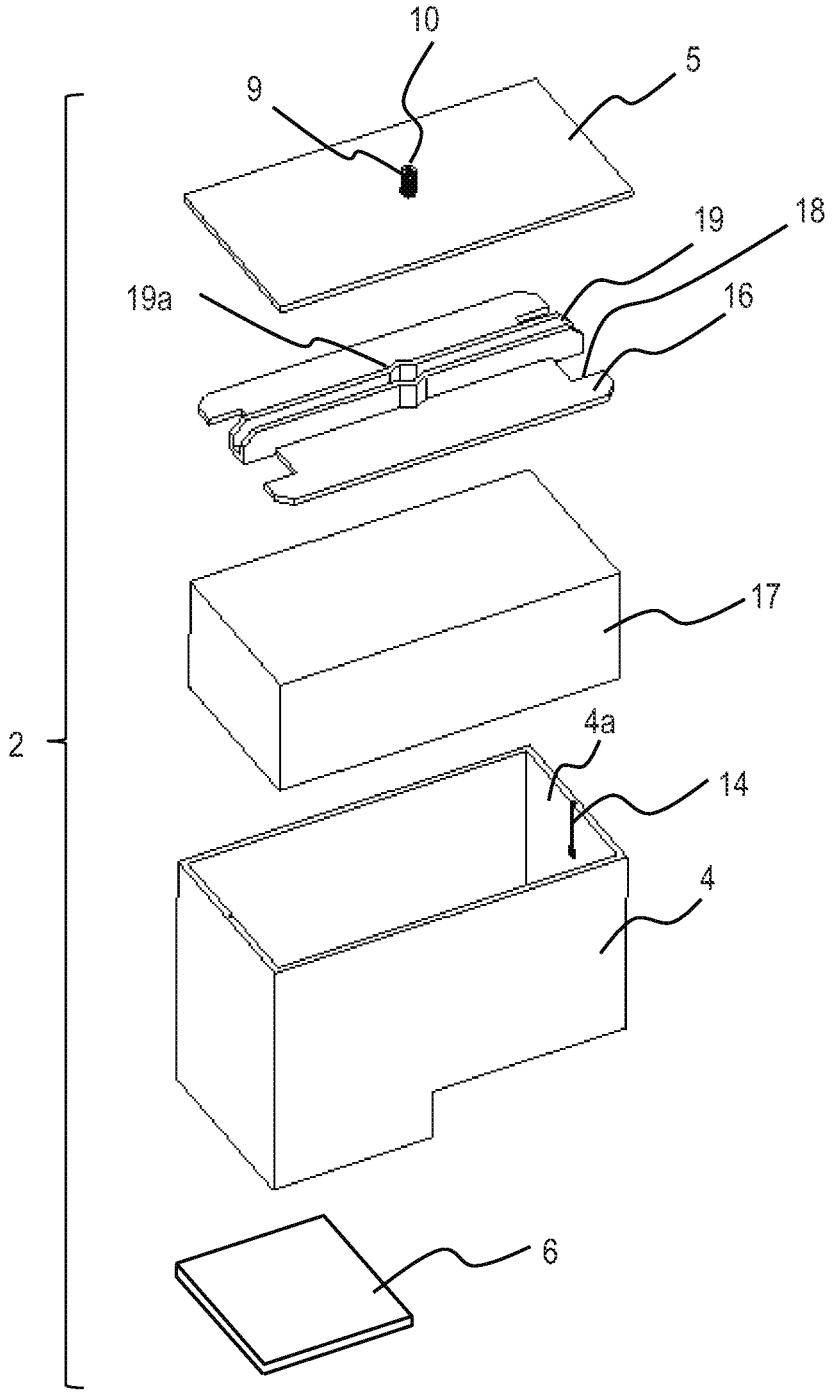
FIG. 10 is an exploded perspective view of a liquid ejection head according to a second embodiment of the present disclosure.

Next, a second embodiment of the present disclosure is described. FIG. 10 is an exploded perspective view of a liquid ejection head 2 according to this embodiment. The liquid ejection head 2 of this embodiment includes an inner lid member 16 arranged inside the casing in addition to the casing 4 and the lid member 5 similar to those of the first embodiment.

Figure 11A:
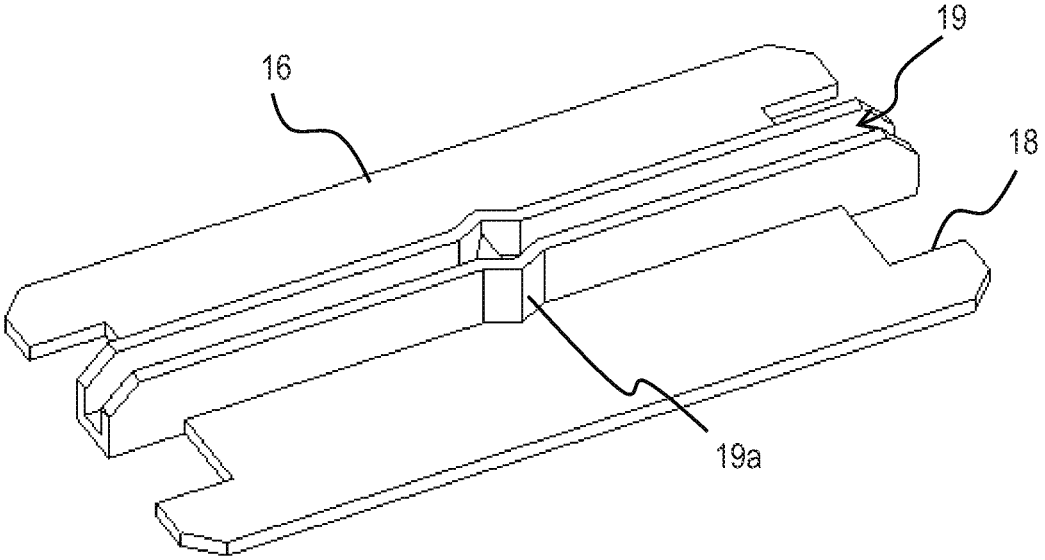
FIG. 11A is a perspective view of an inner lid member of the liquid ejection head illustrated in FIG. 10.
Figure 11B:
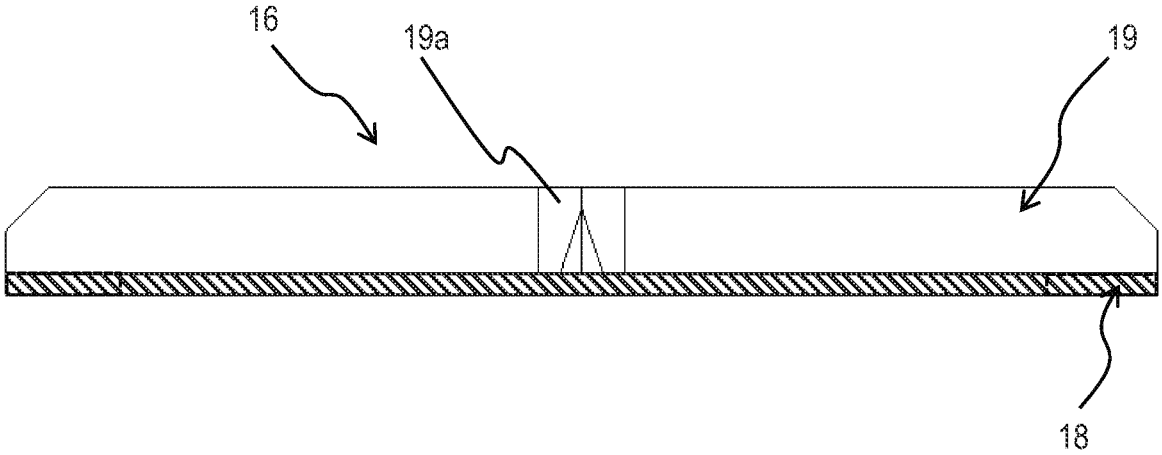
FIG. 11B is a sectional view of the inner lid member of the liquid ejection head illustrated in FIG. 10.

FIG. 11A is a perspective view of the inner lid member 16 of this embodiment, and FIG. 11B is a sectional view of the inner lid member 16 taken along a first liquid guide groove 19 described later. The inner lid member 16 is arranged inside the casing 4 and above a liquid holding member 17.

The liquid holding member 17 of this embodiment does not have the first liquid guide groove. The inner lid member 16 has cutouts 18 at end portions thereof, and has the first liquid guide groove 19 at an upper surface thereof. Similarly to the first liquid guide groove 13 of the first embodiment, the first liquid guide groove 19 extends to end surfaces of the inner lid member 16 which are in contact with or close to the side wall inner surfaces 4*a* of the casing 4 under a state in which the inner lid member 16 is accommodated in the liquid storage portion of the hollow casing 4. The second liquid guide grooves 14 similar to those of the first embodiment are formed in the side wall inner surfaces 4*a* of the casing 4. The first liquid guide groove 19 in the inner lid member 16 and the second liquid guide grooves 14 in the casing 4 are located such that liquid can flow therethrough, and are in a so-called fluid communicating state. As illustrated in FIG. 11B, in the first liquid guide groove 19, a projecting portion 19*a* that guides liquid to the first liquid guide groove 19 is formed at a position opposed to the liquid supply port 10 of the lid member 5.

When the liquid is supplied from the liquid container 12 into the casing 4 through the tube 8 and the liquid supply port 10 similarly to the first embodiment, the liquid is dropped onto an upper surface of the inner lid member 16. Part of the liquid having reached the upper surface of the inner lid member 16 flows from the first liquid guide groove 19 and passes through the second liquid guide grooves 14 to spread over the entire periphery of the opening end portion of the casing 4 which is fixed to the lid member 5. Even if minute air gaps are generated in the joined portion (fused portion 11) between the casing 4 and the lid member 5 or the vicinity thereof, the scalability of the joined portion is maintained by a meniscus of the liquid having been guided over the entire periphery so that the reliability of the sealing can be improved, thereby obtaining the same effects as those of the first embodiment. That is, in this embodiment, a member having the first liquid guide groove 19 formed in an upper surface thereof is not the liquid holding member 17 but the inner lid member 16. With this, in this embodiment, the degree of freedom in the material, the size, and the shape of the liquid holding member 17 is high. Thus, any liquid holding member 17 may be used, and it is not required to perform surface treatment.

Another part of the liquid having reached the upper surface of the inner lid member 16 overflows from a portion other than the first liquid guide groove 19 or the first liquid guide groove 19 to flow from the cutouts 18 toward the liquid holding member 17 located below the inner lid member 16, and is absorbed. The liquid absorbed into the liquid holding member 17 is fed to the flow passage in the element substrate 6. The second embodiment may be the same as the first embodiment except for the configurations and the steps described above, and hence description thereof is omitted.

Third Embodiment

Figure 12A:
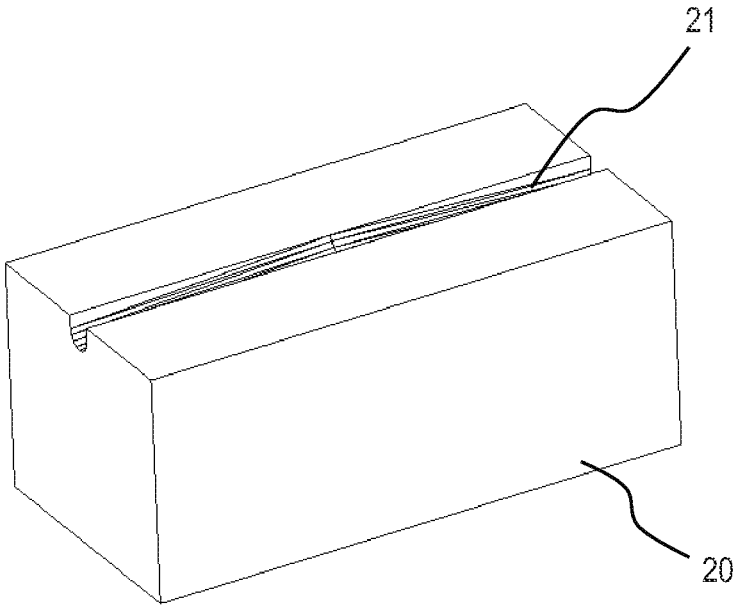
FIG. 12A is a perspective view of a liquid holding member of a liquid ejection head according to a third embodiment of the present disclosure.
Figure 12B:
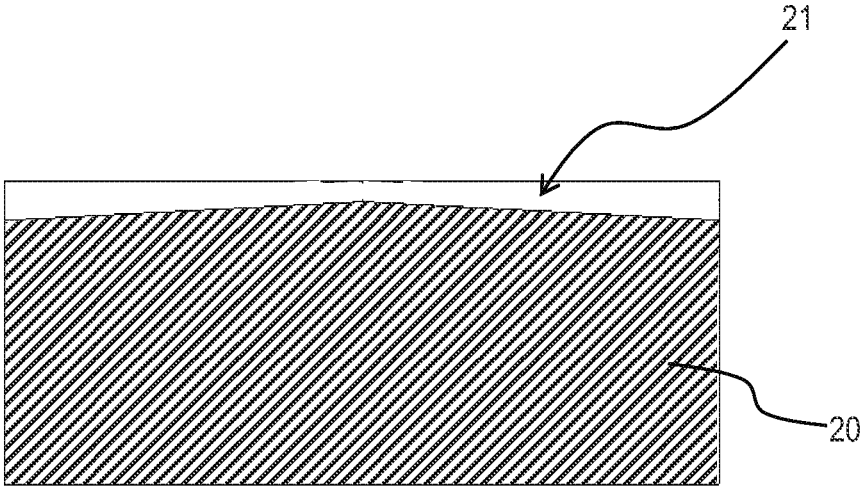
FIG. 12B is a sectional view of the liquid holding member of the liquid ejection head according to the third embodiment of the present disclosure.

Next, a third embodiment of the present disclosure is described. FIG. 12A is a perspective view of a liquid holding member 20 of a liquid ejection head 2 according to this embodiment, and FIG. 12B is a sectional view of the liquid holding member 20 taken along a first liquid guide groove 21 described later. As illustrated in FIG. 12A and FIG. 12B, the first liquid guide groove 21 is formed in an upper surface of the liquid holding member 20 of this embodiment.

The first liquid guide groove 21 has a shape inclined downward from a position opposed to the liquid supply port 10 toward the second liquid guide grooves 14 in the side wall inner surfaces 4*a* of the casing 4. In this embodiment, even when the liquid ejection apparatus 1 is installed in a slightly inclined posture, liquid dropped onto the upper surface of the liquid holding member 20 moves while being divided into two systems similarly to the state illustrated in FIG. 9A. That is, the liquid moves from the first liquid guide groove 21 to the second liquid guide grooves 14 with more reliability. Similarly to the first embodiment, the reliability of the sealing can be improved. The third embodiment may be the same as the first embodiment except for the configurations and the steps described above, and hence description thereof is omitted.

Fourth Embodiment

Figure 13:
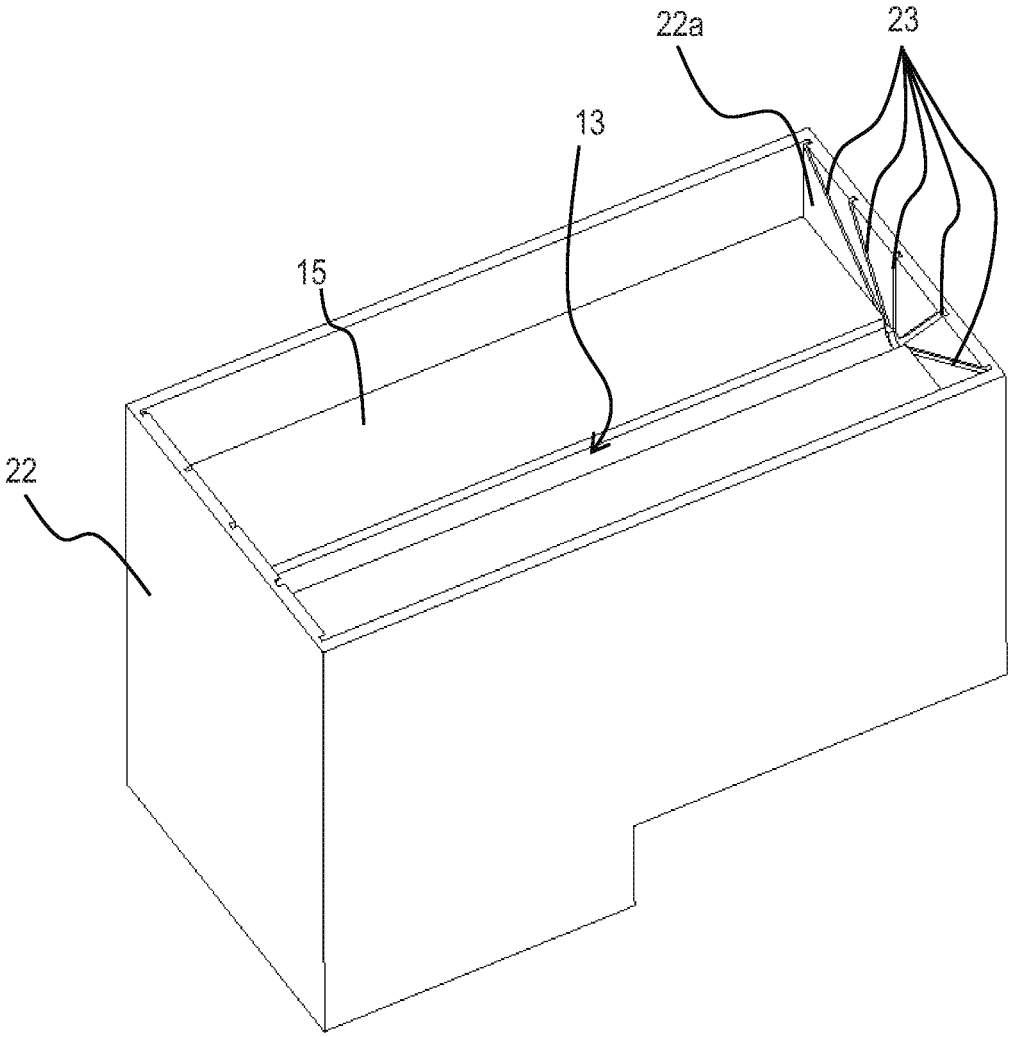
FIG. 13 is a perspective view of a casing and a liquid holding member of a liquid ejection head according to a fourth embodiment of the present disclosure.

Next, a fourth embodiment of the present disclosure is described. FIG. 13 is a perspective view of a casing 22 and a liquid holding member 15 of a liquid ejection head 2 according to this embodiment. The casing 22 of this embodiment has five second liquid guide grooves 23 that expand in a fan shape (radial shape) from a position in contact with or close to the first liquid guide groove 13 in the liquid holding member 15 toward the opening end portion in a side wall inner surface 22*a*. In this embodiment, the liquid moves from the first liquid guide groove 13 to the second liquid guide grooves 23 with more reliability. Similarly to the first embodiment, the reliability of the sealing can be improved. The fourth embodiment may be the same as the first embodiment except for the configurations and the steps described above, and hence description thereof is omitted.

Fifth Embodiment

Figure 14:
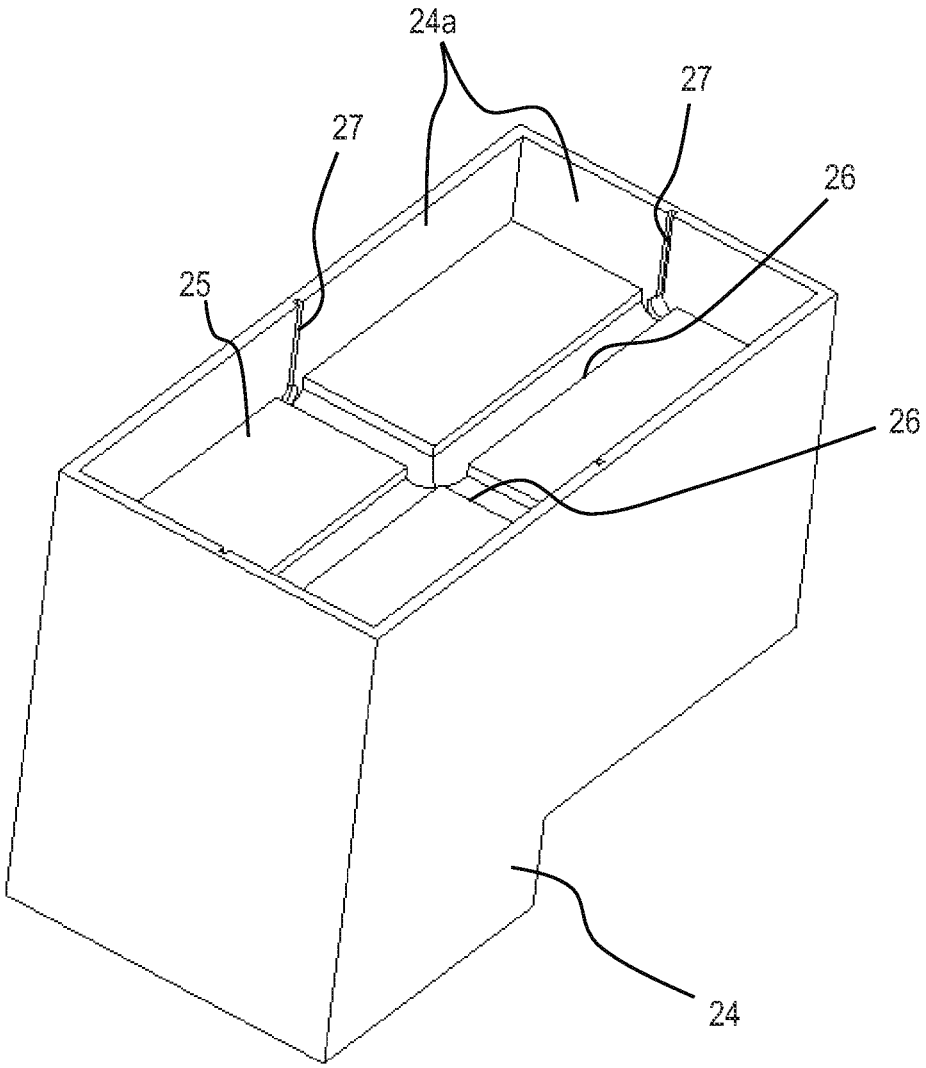
FIG. 14 is a perspective view of a casing and a liquid holding member of a liquid ejection head according to a fifth embodiment of the present disclosure.

Next, a fifth embodiment of the present disclosure is described. FIG. 14 is a perspective view of a casing 24 and a liquid holding member 25 of a liquid ejection head 2 according to this embodiment. Two first liquid guide grooves 26 that cross each other perpendicularly to form a cross shape are formed in an upper surface of the liquid holding member 25 of this embodiment. A second liquid guide groove 27 extending from a position in contact with or close to the first liquid guide groove 26 toward the opening end portion is formed in each of four side wall inner surfaces 24*a* of the casing 24. In this embodiment, the liquid moves from the first liquid guide groove 26 to the second liquid guide grooves 27 with more reliability. Similarly to the first embodiment, the reliability of the sealing can be improved. The fifth embodiment may be the same as the first embodiment except for the configurations and the steps described above, and hence description thereof is omitted.

Sixth Embodiment

Figure 15:
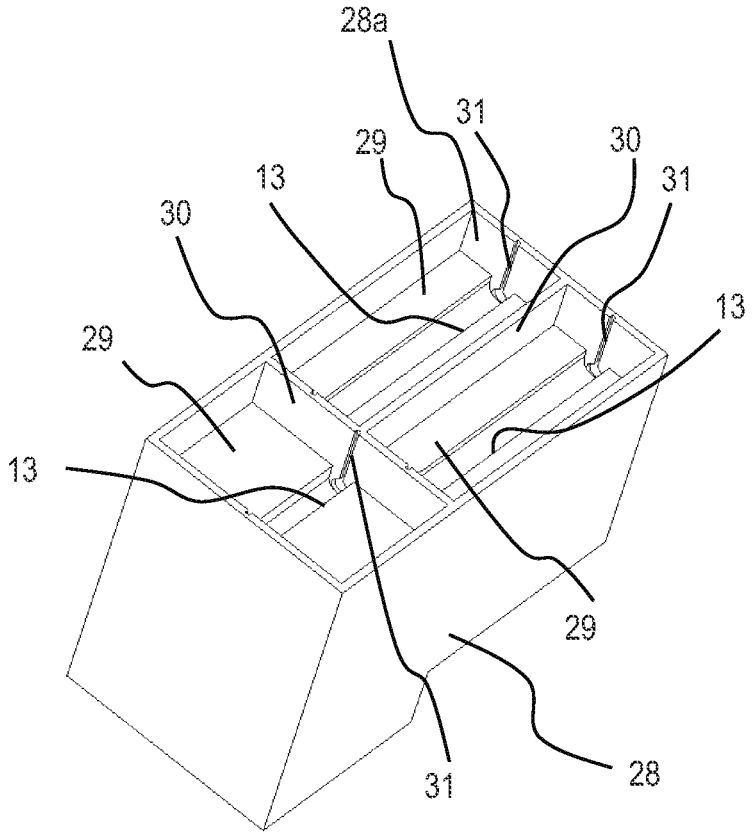
FIG. 15 is a perspective view of a casing and a liquid holding member of a liquid ejection head according to a sixth embodiment of the present disclosure.

Next, a sixth embodiment of the present disclosure is described. FIG. 15 is a perspective view of a casing 28 and liquid holding members 29 of a liquid ejection head 2 according to this embodiment. The casing 28 of this embodiment includes partition walls 30 inside, and the liquid storage portion inside the casing 28 is divided into a plurality of (for example, three) sections by the partition walls 30. A portion of the liquid holding member 29 is accommodated in each section of the liquid storage portion. The first liquid guide groove 13 similar to that of the first embodiment is formed in each liquid holding member 29. A second liquid guide groove 31 that extends from a position in contact with or close to the first liquid guide groove 13 toward the opening end portion, which is similar to that of the first embodiment, is formed in each of a side wall inner surface 28*a* of the casing 28 and the partition wall 30. In this embodiment, in the liquid ejection head 2 that ejects liquid of multiple colors, the sections of the liquid storage portion are selectively used for each color such that the liquid of each color is not mixed, thereby being capable of improving the reliability of the scaling for each liquid similarly to the first embodiment. The sixth embodiment may be the same as the first embodiment except for the configurations and the steps described above, and hence description thereof is omitted.

The configurations of the embodiments described above may also be optionally combined with each other. In the third to sixth embodiments, the inner lid member may be provided similarly to the second embodiment so that the member having the first liquid guide groove formed in an upper surface thereof may not be the liquid holding member but may be the inner lid member.

More specific examples of the above-mentioned embodiments of the present disclosure are described.

Example 1

In Example 1 of the present disclosure, the liquid ejection head 2 according to the above-mentioned first embodiment was manufactured. The liquid ejection head 2 of this example was formed using a material in which filler was filled at a proportion of 50% as resin forming the casing and the lid member. Further, in the casing, the liquid holding member 15 (see FIG. 6) having the first liquid guide groove 13 having a semicircular column recessed shape of a diameter of about 3.25 mm and a length of about 53 mm was accommodated.

The inner surface of the first liquid guide groove 13 was subjected to surface treatment by heating via a Teflon (trademark) sheet from a heat plate of about 200° C. so that liquid was less liable to penetrate. The side wall inner surface 4*a* of the casing 4 had the second liquid guide groove 14 (see FIG. 7A and FIG. 7B) of a width of about 0.5 nm, a depth of about 0.5 mm, and a height of about 7.5 mm.

The liquid ejection head 2 was mounted to the carriage 3 of the liquid ejection apparatus 1 which was described in FIG. 1, and was left for 24 hours under a state in which the tube 8 was filled with liquid so that the liquid ejection head 2 was in a stable state without movement of liquid as illustrated in FIG. 8D. Further, as a comparative example, although not illustrated, a material in which filler was filled in resin at a proportion of 50% was used to form a liquid ejection head. A liquid ejection head including a liquid holding member having no first liquid guide groove and a casing having no second liquid guide groove was manufactured. The liquid ejection head 2 of the comparative example was also mounted to the carriage 3 of the liquid ejection apparatus 1 illustrated in FIG. 1, and was left for 24 hours under the state illustrated in FIG. 8D. The liquid used in this example and the comparative example was liquid ink having a surface tension of about 0.03 (N/m).

In the liquid ejection head of the comparative example, after the liquid ejection head was left for 24 hours, minute leakage of gas occurs in the joined portion between the casing and the lid member, with the result that the negative pressure in the liquid ejection head was not able to be kept. As a result, a phenomenon in which the liquid in the tube moves to the liquid container side occurs. In contrast, in the liquid ejection head 2 of this example, minute air gaps in the joined portion (fused portion 11) or the like were closed by the meniscus of the liquid that had reached the end portion of the opening of the casing 4 which was fixed to the lid member 5 so that the negative pressure in the liquid ejection head 2 was able to be kept. Thus, in the liquid ejection head 2 of this example, a drive signal was sent to the liquid ejection apparatus 1 so that recording by liquid ejection was able to be performed. When the liquid ejection head 2 of this example was observed while being cut horizontally along the end portion of the opening of the casing 4, it was able to be confirmed that the liquid that had moved through the second liquid guide groove 14 spread over the entire periphery.

Example 2

In Example 2 of the present disclosure, the liquid ejection head 2 according to the above-mentioned second embodiment was manufactured. Similarly to Example 1, the liquid ejection head 2 of this example was made of a material in which filler was filled in resin at a proportion of 50%. Further, in the casing, the inner lid member 16 (see FIG. 11A and FIG. 11B) having the first liquid guide groove 19 of a width of about 2 mm, a depth of about 4 mm, and a length of about 53 mm and the liquid holding member 17 having no first liquid guide groove were accommodated. Other configurations were the same as those of the liquid ejection head of Example 1. The liquid ejection head 2 was processed similarly to Example 1, and the maintained state of the negative pressure in the liquid ejection head 2 and the moving state of the liquid to the joined portion were verified. As a result, satisfactory effects were obtained similarly to Example 1.

Example 3

In Example 3 of the present disclosure, the liquid ejection head 2 according to the above-mentioned third embodiment was manufactured. The liquid ejection head 2 of this example was also made of the same material as that of Example 1. The liquid holding member 20 (see FIG. 12A and FIG. 12B) having the first liquid guide groove 21 having a semicircular column recessed shape of a diameter of about 3.25 mm and a length of about 53 mm was accommodated. The first liquid guide groove 21 had a shape inclined downward at about 4° from a position opposed to the liquid supply port 10 toward the second liquid guide grooves 14 in the side wall inner surfaces 4*a* of the casing 4. Other configurations were the same as those of the liquid ejection head of Example 1. The liquid ejection head 2 was processed similarly to Example 1, and the maintained state of the negative pressure in the liquid ejection head 2 and the moving state of the liquid to the joined portion were verified. As a result, satisfactory effects were obtained similarly to Example 1.

Example 4

In Example 4 of the present disclosure, the liquid ejection head 2 according to the above-mentioned fourth embodiment was manufactured. The liquid ejection head 2 of this example was also made of the same material as that of Example 1. The casing 22 (see FIG. 13) in which the five second liquid guide grooves 23 that expanded in a fan shape (radial shape) from a position in contact with or close to the first liquid guide groove 13 in the liquid holding member 15 toward the opening end portion were formed in the side wall inner surface were accommodated. The five second liquid guide grooves 23 each had a width of about 0.5 mm, a depth of about 0.5 mm, and a height of about 7.5 mm. Other configurations were the same as those of the liquid ejection head of Example 1. The liquid ejection head 2 was processed similarly to Example 1, and the maintained state of the negative pressure in the liquid ejection head 2 and the moving state of the liquid to the joined portion were verified. As a result, satisfactory effects were obtained similarly to Example 1.

Example 5

In Example 5 of the present disclosure, the liquid ejection head 2 according to the above-mentioned fifth embodiment was manufactured. The liquid ejection head 2 of this example was also made of the same material as that of Example 1. The liquid ejection head 2 of this example included the liquid holding member 25 having the two cross-shaped first liquid guide grooves 26 in the upper surface, and the casing 24 in which the second liquid guide groove 27 extending from a position in contact with or close to the first liquid guide groove 26 toward the opening end portion was formed in each of four side wall inner surfaces. Each first liquid guide groove 26 had a semicircular column recessed shape of a diameter of about 3.25 mm and a length of about 53 mm, and the second liquid guide groove 27 had a width of about 0.5 mm, a depth of about 0.5 mm, and a height of about 7.5 mm (see FIG. 14). Other configurations were the same as those of the liquid ejection head of Example 1. The liquid ejection head 2 was processed similarly to Example 1, and the maintained state of the negative pressure in the liquid ejection head 2 and the moving state of the liquid to the joined portion were verified. As a result, satisfactory effects were obtained similarly to Example 1.

Example 6

In Example 6 of the present disclosure, the liquid ejection head 2 according to the above-mentioned sixth embodiment was manufactured. The liquid ejection head 2 of this example was also made of the same material as that of Example 1. The liquid ejection head 2 of this example included the casing 28 including the partition wall 30 that divided the liquid storage portion into three sections (see FIG. 15). The liquid holding member 29 was accommodated in each of three sections divided by the partition wall 30 in the liquid storage portion of the casing 28. In the upper surface of each liquid holding member 29, the first liquid guide groove 13 having a semicircular column recessed shape of a diameter of about 3.25 mm, which extended over the entire liquid holding member 29, was formed. In each of the side wall inner surfaces and the partition wall 30 of the casing 28, the second liquid guide groove 31 having a width of about 0.5 mm, a depth of about 0.5 mm, and a height of about 7.5 mm, which extended form a position in contact with or close to the first liquid guide groove 13 toward the opening end portion, was formed. Other configurations were the same as those of the liquid ejection head of Example 1. The liquid ejection head 2 was processed similarly to Example 1, and the maintained state of the negative pressure in the liquid ejection head 2 and the moving state of the liquid to the joined portion were verified. As a result, satisfactory effects were obtained similarly to Example 1.

According to the present disclosure, it is possible to provide a liquid ejection head and a liquid ejection apparatus in which reliability of sealing is high for a liquid ejection head made of a material having a large content of filler. Further, it is needless to say that, even in a liquid ejection head made of a material having a small content of filler, reliability of sealability is further improved.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2021-061754, filed Mar. 31, 2021, and Japanese Patent Application No. 2021-201812, filed Dec. 13, 2021, which are hereby incorporated by reference herein in their entirety.

What is claimed is:

1. A liquid ejection head comprising:

a casing which is hollow, and has an opening at one end;

a lid member which is fixed to an end portion of the opening of the casing, and closes the opening; and a member arranged inside the casing, wherein the lid member has a liquid supply port for supplying liquid into the casing, wherein the member has a first liquid guide groove formed in an upper surface of the member which is a surface onto which the liquid supplied through the liquid supply port is to be dropped, and the casing has a second liquid guide groove formed in a side wall inner surface of the casing, and wherein the second liquid guide groove extends from the end portion of the opening which is fixed to the lid member to a side opposite to the opening, the first liquid guide groove extends to a side surface of the member which is disposed adjacent to the side wall inner surface of the casing, and the first liquid guide groove and the second liquid guide groove are disposed so as to allow fluid communication therebetween.

2. The liquid ejection head according to claim 1, wherein a part of the second liquid guide groove is located on an extension of the first liquid guide groove.

3. The liquid ejection head according to claim 1, wherein the member having the first liquid guide groove formed in an upper surface thereof is a liquid holding member.

4. The liquid ejection head according to claim 3, wherein an inner wall surface of the first liquid guide groove is subjected to surface treatment.

5. The liquid ejection head according to claim 1, wherein a liquid holding member and an inner lid member located above the liquid holding member are arranged inside the casing, and the member having the first liquid guide groove is the inner lid member.

6. The liquid ejection head according to claim 5, wherein the inner lid member has a cutout which allows liquid to flow toward the liquid holding member.

7. The liquid ejection head according to claim 1, wherein the liquid ejection head is configured for liquid guided from the first liquid guide groove and the second liquid guide groove to the end portion of the opening to spread over an entire periphery of the end portion of the opening.

8. The liquid ejection head according to claim 7, wherein the lid member is fixed to the end portion of the opening of the casing by welding, and the liquid ejection head is configured for the liquid guided to the end portion of the opening to spread over the entire periphery of the end portion of the opening on an inner side of the casing with respect to a fused portion formed by welding between the lid member and the end portion of the opening of the casing.

9. The liquid ejection head according to claim 1, wherein an element substrate for ejecting liquid is mounted to the casing on a side opposite to the opening.

10. The liquid ejection head according to claim 1, wherein the first liquid guide groove has a shape inclined downward from a position opposed to the liquid supply port toward the second liquid guide groove in the side wall inner surface of the casing.

11. The liquid ejection head according to claim 1, wherein the casing has a plurality of the second liquid guide grooves formed in the side wall inner surface of the casing such that the plurality of the second liquid guide grooves expand radially from a position adjacent to the first liquid guide groove toward the end portion of the opening.

12. The liquid ejection head according to claim 1, wherein the member has two first liquid guide grooves crossing each other and being formed in an upper surface of the member, and the casing has the second liquid guide groove formed in each of four side wall inner surfaces.

13. The liquid ejection head according to claim 1, wherein the casing includes a partition wall inside the casing, a portion of the member is arranged in each of sections divided by the partition wall, the portion of the member has the first liquid guide groove, and each of the inner wall surface and the partition wall of the casing has the second liquid guide groove.

14. A liquid ejection apparatus comprising:

a liquid ejection head;

a liquid container configured to accommodate liquid to be supplied to the liquid ejection head; and a connecting member connecting the liquid ejection head and the liquid container to each other, the liquid ejection head including:

a casing, which is hollow, and has an opening at one end;

a lid member, which is fixed to an end portion of the opening of the casing, and closes the opening; and a member arranged inside the casing, wherein the lid member has a liquid supply port for supplying liquid into the casing, wherein the member has a first liquid guide groove formed in an upper surface of the member which is a surface onto which the liquid supplied through the liquid supply port is to be dropped, and the casing has a second liquid guide groove formed in a side wall inner surface of the casing, and wherein the second liquid guide groove extends from the end portion of the opening which is fixed to the lid member to a side opposite to the opening, the first liquid guide groove extends to a side surface of the member which is disposed adjacent to the side wall inner surface of the casing, and the first liquid guide groove and the second liquid guide groove are disposed so as to allow fluid communication therebetween.

* * * * *